US010885845B2

(12) United States Patent
Gai et al.

(10) Patent No.: US 10,885,845 B2
(45) Date of Patent: Jan. 5, 2021

(54) OLED PIXEL DRIVING CIRCUIT, DRIVING METHOD THEREOF AND DISPLAY DEVICE INCLUDING THE SAME

(71) Applicant: BOE TECHNOLOGY GROUP CO., LTD., Beijing (CN)

(72) Inventors: Cuili Gai, Beijing (CN); Yi Cheng Lin, Beijing (CN); Ling Wang, Beijing (CN); Baoxia Zhang, Beijing (CN); Pan Xu, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 36 days.

(21) Appl. No.: 16/022,756

(22) Filed: Jun. 29, 2018

(65) Prior Publication Data

US 2019/0180687 A1 Jun. 13, 2019

(30) Foreign Application Priority Data

Dec. 11, 2017 (CN) ..... 2017 1 1310272

(51) Int. Cl.

*G09G 3/32* (2016.01)
*G09G 3/3258* (2016.01)
*G09G 3/3233* (2016.01)

(52) U.S. Cl.

CPC ..... *G09G 3/3258* (2013.01); *G09G 3/3233* (2013.01); *G09G 2300/0819* (2013.01);
(Continued)

(58) Field of Classification Search

CPC ..... G09G 3/3258; G09G 3/3233; G09G 2320/0233; G09G 2320/045
See application file for complete search history.

(56) References Cited

U.S. PATENT DOCUMENTS

2016/0240138 A1* 8/2016 Xu ..... G09G 3/32
2018/0130412 A1* 5/2018 Zhang ..... G09G 3/32

FOREIGN PATENT DOCUMENTS

CN 104821150 A 8/2015
CN 106097965 A 11/2016
(Continued)

OTHER PUBLICATIONS

First Office Action for Chinese Patent Application No. 201711310272.1 dated Mar. 18, 2019.

*Primary Examiner* — Towfiq Elahi
(74) *Attorney, Agent, or Firm* — Calfee, Halter & Griswold LLP

(57) ABSTRACT

The present disclosure provides an OLED pixel driving circuit, a driving method thereof and a display device including the same. The OLED pixel driving circuit includes: a first transistor, providing driving current to an organic light emitting diode, and comprising a first terminal, second terminal and control terminal coupled to a first node, second node and third node respectively; a power switch unit, coupled between a power supply voltage and the second node; a first switch unit, coupled between a data line and a fourth node to couple a data voltage signal from the data line to the fourth node; a second switch unit, coupled between the third node and the second node to enable the first transistor connected as a diode; a first capacitor, coupled between the fourth node and the first node; and a second capacitor, coupled between the fourth node and the second node.

17 Claims, 3 Drawing Sheets

(52) U.S. Cl.
CPC ..... *G09G 2300/0852* (2013.01); *G09G 2300/0866* (2013.01); *G09G 2320/0233* (2013.01); *G09G 2320/045* (2013.01)

(56) References Cited

FOREIGN PATENT DOCUMENTS

| | | | |
|---|---|---|---|
| CN | 106847182 | A | 6/2017 |
| CN | 107369412 | A | 11/2017 |

* cited by examiner

OLED PIXEL DRIVING CIRCUIT, DRIVING METHOD THEREOF AND DISPLAY DEVICE INCLUDING THE SAME

CROSS-REFERENCE

The present application is based upon and claims priority to Chinese Patent Application No. 201711310272.1, filed on Dec. 11, 2017, and the entire contents thereof are incorporated herein by reference.

TECHNICAL FIELD

The present disclosure relates to the field of display technology, in particular, to an OLED pixel driving circuit, a driving method of the OLED pixel driving circuit and a display device including the OLED pixel driving circuit.

BACKGROUND

Compared with the liquid crystal display device in the conventional technology, the organic light emitting diode (OLED) display device has the characteristics of fast response, excellent color purity and brightness, high contrast, wide viewing angle, and the like.

Generally, the OLED display device can be classified into passive matrix OLED (PMOLED) display device and active matrix OLED (AMOLED) display devices according to the driving methods.

The structure and driving method of the PMOLED display device are relatively simple, which makes the PMOLED display device easy to be manufactured, but the PMOLED display device has limited resolution and size. Therefore, generally, the PMOLED display device is relatively small and is used to display character data and small icons.

The AMOLED is driven by a thin film transistor (TFT) including a storage capacitor, so that a large-sized and high-resolution display panel can be realized. The AMOLED display device can be made much larger than the PMOLED display device and are not limited by size and resolution. Therefore, the AMOLED display device is considered to be the development direction of future display technologies.

For the AMOLED display device, the current flowing through the OLED at different time points for the same image data voltage is different due to manufacturing process, instability of the driving transistor, aging of the OLED, and the like, resulting in that the display brightness of the entire display panel is not uniform.

It should be noted that the information disclosed in the foregoing background section is only for enhancement of understanding of the background of the present disclosure and therefore may include information that does not constitute the prior art that is already known to those of ordinary skill in the art.

SUMMARY

The present disclosure provides an OLED pixel driving circuit, a driving method of the OLED pixel driving circuit and a display device including the OLED pixel driving circuit.

According to one aspect of the present disclosure, there is provided an OLED pixel driving circuit, including: a first transistor, configured to provide a driving current to an organic light emitting diode, and comprising a first terminal, a second terminal and a control terminal coupled to a first node, a second node and a third node respectively, the first node being coupled to the organic light emitting diode; a power switch unit, coupled between a power supply voltage and the second node to be turned on or off in response to a first control signal; a first switch unit, coupled between a data line and a fourth node to couple a data voltage signal from the data line to the fourth node when being turned on in response to a signal from a scan line; a second switch unit, coupled between the third node and the second node to enable the first transistor connected as a diode when being turned on in response to a second control signal; a first capacitor, coupled between the fourth node and the first node; and a second capacitor, coupled between the fourth node and the second node.

According to an exemplary embodiment, the first switch unit may include a second transistor, and the second transistor includes a first terminal, a second terminal and a control terminal coupled to the data line, the fourth node and the scan line respectively.

According to an exemplary embodiment, the second switch unit may include a third transistor, and the third transistor includes a first terminal, a second terminal and a control terminal coupled to the third node, the second node and the second control signal respectively.

According to an exemplary embodiment, the power switch unit may include a fourth transistor, and the fourth transistor includes a first terminal, a second terminal and a control terminal coupled to the second node, the power supply voltage and the first control signal respectively.

According to an exemplary embodiment, the fourth transistor may be a PMOS transistor, and the second transistor may be an NMOS transistor.

According to an exemplary embodiment, the first control signal may be from the scan line.

According to an exemplary embodiment, the first transistor may be an NMOS transistor.

According to an exemplary embodiment, the power switch unit and the first switch unit may be turned on and off in a complementary manner.

According to another aspect of the present disclosure, there is provided a driving method of any of the above OLED pixel driving circuits, including: turning on the first switch unit and the second switch unit to apply a reference voltage through the data line, and turning off the power switch unit to stop applying the power supply voltage to the second node, so that a voltage of the fourth node is reset and the second capacitor stores a threshold voltage of the first transistor; maintaining the first switch unit turned on and turning off the second switch unit, so that the first capacitor stores a data voltage from the data line; and turning off the first switch unit, maintaining the second switch unit turned off and turning on the power switch unit to apply the power supply voltage to the second node, so that the first transistor drives the organic light emitting diode to emit light.

According to still another aspect of the present disclosure, there is provided an OLED display device, including any one of the above OLED pixel driving circuits and an organic light emitting diode.

BRIEF DESCRIPTION OF THE DRAWINGS

The accompanying drawings, which are included herein to provide a further understanding of the present disclosure. The accompanying drawings, which are incorporated in and constitute a part of this application, illustrate embodiments of the present disclosure and together with the description serve to explain the principle of the present disclosure. Obviously, the following drawings are merely some embodiments of the present disclosure, and those skilled in the art can also obtain other drawings based on these drawings without any creative work. In the drawings.

DETAILED DESCRIPTION

Exemplary embodiments will now be described more fully with reference to the accompanying drawings. However, the exemplary embodiments can be implemented in various forms and should not be construed as limited to the examples set forth herein; rather, these embodiments are provided so that this disclosure will be more complete and thorough, and will fully convey the concept of the exemplary embodiments to those skilled in the art. The features, structures, or characteristics described may be combined in any suitable manner in one or more embodiments.

It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Hereinafter, the present disclosure will be explained in detail with reference to the accompanying drawings.

Figure 1:
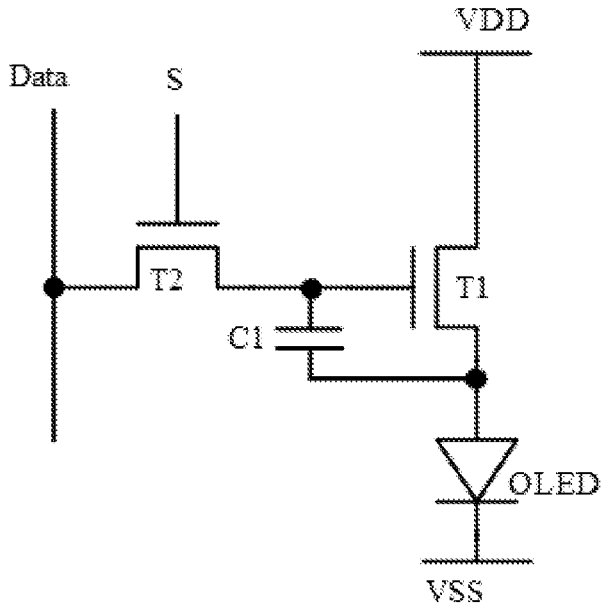
FIG. 1 is a schematic diagram showing an OLED pixel driving circuit.

FIG. 1 is a schematic diagram showing an OLED pixel driving circuit.

As shown in FIG. 1, the OLED pixel driving circuit has a 2T1C structure including a first transistor T1, a second transistor T2, and a storage capacitor C1. A control signal is applied through a scan line S to control the turning on and off of the second transistor T2, for writing a data voltage to the OLED pixel driving circuit through a data line Data. The first transistor T1 is used to control the light emission of the organic light emitting diode OLED. The storage capacitor C1 is used to provide a maintaining voltage to the gate of the first transistor T1.

When the organic light emitting diode OLED is driven to emit light through the OLED pixel driving circuit, the driving current $I_{OLED}$ can be expressed as:

$$I_{OLED} = \frac{1}{2}\mu_n - Cox - \frac{W}{L} - (Vdata - Voled - Vth)^2$$

In the above equation, $\mu_n$ represents a carrier mobility of the first transistor T1, Cox represents a gate oxide capacitance of the first transistor T1, W/L represents a width to length ratio of the transistor, Vdata represents a data voltage, Voled represents an operating voltage of the OLED which is shared by all pixel units, and Vth represents a threshold voltage of the first transistor T1. As can be seen from the above equation, if the threshold voltage Vth is different between different pixel units, there is a difference in the driving current, resulting in uneven brightness of the display; and if the threshold voltage Vth of the driving transistor drifts over time, the previous current and the subsequent current may be different, which affects the display effect.

According to an exemplary embodiment of the present disclosure, there is provided an OLED pixel driving circuit. The OLED pixel driving circuit may include: a first transistor (i.e., a driving transistor), providing a driving current to an organic light emitting diode (OLED), and including a first terminal, a second terminal and a control terminal coupled to a first node, a second node and a third node respectively, the first node being coupled to the organic light emitting diode; a power switch unit, coupled between a power supply voltage and the second node to be turned on or off in response to a first control signal; a first switch unit, coupled between a data line and a fourth node to couple a data voltage signal from the data line to the fourth node when being turned on in response to a signal from a scan line; a second switch unit, coupled between the third node and the second node to enable the first transistor connected as a diode when being turned on in response to a second control signal; a first capacitor, coupled between the fourth node and the first node; and a second capacitor, coupled between the fourth node and the second node.

According to the OLED pixel driving circuit of the exemplary embodiment, the threshold voltage of the driving transistor and the low-level voltage (ground voltage) of the OLED can be compensated, which may prevent the display brightness of the display device from being not uniform due to the difference and/or drift of the threshold voltage of the driving transistor and the voltage beat of the low-level voltage of the OLED.

Hereinafter, referring to FIG. 2, the OLED pixel driving circuit according to an exemplary embodiment of the present disclosure will be described in detail by taking transistors (i.e., a second transistor T2, a third transistor T3, a fourth transistor T4) as the first switch unit, the second switch unit, and the power switch unit as examples. However, those skilled in the art will recognize that the first switch unit, the second switch unit, and the power switch unit are not limited to be transistors, and any structure and/or circuit capable of realizing its corresponding function can be used as the first switch unit, the second switch unit and the power switch unit.

Figure 2:
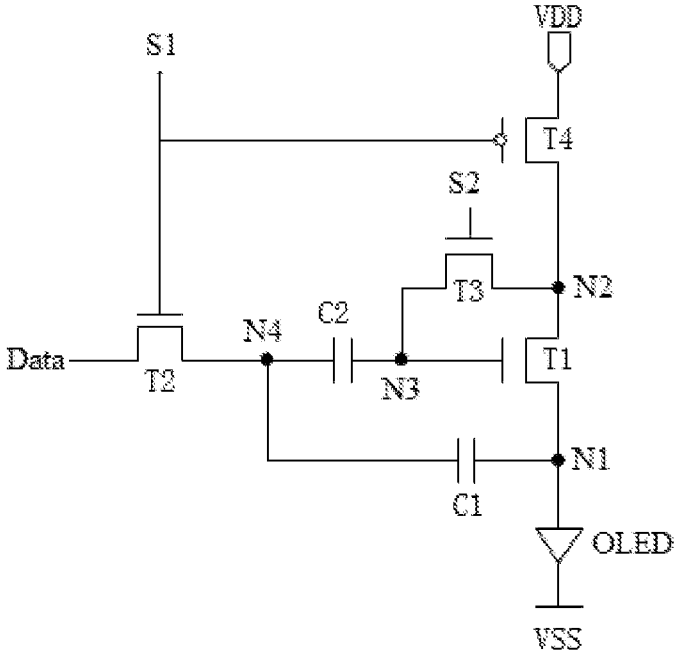
FIG. 2 is a schematic diagram showing an OLED pixel driving circuit according to an exemplary embodiment of the present disclosure.

FIG. 2 is a schematic diagram showing an OLED pixel driving circuit according to an exemplary embodiment of the present disclosure.

As will be appreciated by those skilled in the art, the exemplary OLED pixel driving circuit may be a pixel driving circuit for driving any one of a plurality of pixel units included in an OLED display panel.

Referring to FIG. 2, the OLED pixel driving circuit according to an exemplary embodiment may include a first transistor T1, a second transistor T2 as a first switch unit, a third transistor T3 as a second switch unit, and a fourth transistor T4 as a power switch unit, a first capacitor C1 and a second capacitor C2.

The organic light emitting diode OLED may include an anode electrode, a hole transport layer, an organic light emitting layer, an electron transport layer, and a cathode electrode. When a voltage is applied to the anode electrode and the cathode electrode of the organic light emitting diode OLED, holes and electrons are respectively transported to the organic light emitting layer through the hole transport layer and the electron transport layer, and are recombined in the organic light emitting layer to emit light. The anode electrode of the organic light emitting diode OLED may be coupled to a first node N1 of the OLED pixel driving circuit, and the cathode electrode thereof may be coupled to a low level voltage VSS (e.g., grounded).

The first transistor T1 is used to provide a driving current to the organic light emitting diode OLED. A first terminal, a second terminal, and a control terminal (i.e., a gate) of the first transistor T1 are respectively coupled to the first node N1, a second node N2, and a third node N3. The first node N1 is coupled to the organic light emitting diode OLED.

The fourth transistor T4 as the power switch unit is coupled between a power supply voltage VDD and the second node N2 to be turned on or off in response to a first control signal. According to an exemplary embodiment, a first terminal, a second terminal, and a control terminal (i.e., a gate) of the fourth transistor T4 are respectively coupled to the second node N2, the power supply voltage VDD, and the first control signal.

The second transistor T2 as the first switch unit is coupled between a data line Data and the fourth node N4, for coupling data voltage signal from the data line Data to the four node N4 when being turned on in response to a signal from a scan line S1. According to an exemplary embodiment, a first terminal, a second terminal, and a control terminal (i.e., a gate) of the second transistor T2 are respectively coupled to the data line Data, the fourth node N4, and the scan line S1.

The third transistor T3 as the second switch unit is coupled between the third node N3 and the second node N2, for enabling the first transistor T1 connected as a diode when being turned on in response to a second control signal from a control line S2. According to an exemplary embodiment, a first terminal, a second terminal, and a control terminal (i.e., a gate) of the third transistor T3 are respectively coupled to the third node N3, the second node N2, and the second control signal.

The first capacitor C1 may be coupled between the first node N1 and the fourth node N4. That is, the plates of the first capacitor C1 may be respectively coupled to the first node N1 and the second node N4 to buffer and maintain the data voltage.

The second capacitor C2 may be coupled between the fourth node N4 and the third node N3. That is, the plates of the second capacitor C2 may be coupled to the fourth node N4 and the third node N3, respectively, to couple the voltage of the fourth node N4 and the voltage of the third node N3.

According to the above-described OLED pixel driving circuit according to an exemplary embodiment of the present disclosure, the threshold voltage of the first transistor T1 and the low-level voltage VSS can be compensated, which may prevent the display brightness of the display device from being not uniform due to the difference and/or drift of the threshold voltage of the driving transistor and the voltage beat of the low-level voltage of the OLED. This will be described in detail in the following description of a driving method of the OLED pixel driving circuit according to an exemplary embodiment of the present disclosure.

According to an exemplary embodiment of the present disclosure, the power switch unit and the first switch unit may be turned on and off in a complement manner. That is, when the power switch unit is turned on, the first switch unit is turned off; and when the power switch unit is turned off, the first switch unit is turned on.

In this case, according to an exemplary embodiment of the present disclosure, the fourth transistor T4 as the power switch unit may be a PMOS transistor, and the second transistor T2 as the first switch unit may be an NMOS transistor. The control terminals of the fourth transistor T4 and the second transistor T2 are both coupled to the scan line S1 so that the fourth transistor T4 and the second transistor T2 are controlled to be turned on and off in a complement manner through the signal from the scan line.

However, the present disclosure is not limited thereto, for example, the fourth transistor T4 and the second transistor T2 may be the same type of transistor, for example, the same NMOS transistor or PMOS transistor. In this case, for example, a signal inverting circuit may be disposed between the control terminal of the fourth transistor T4 and the scan line S1, so that the fourth transistor T4 and the second transistor T2 may be turned on and off in a complement manner.

In addition, according to an exemplary embodiment of the present disclosure, the first transistor T1 and the third transistor T3 may be NMOS transistors.

The OLED pixel driving circuit according to an embodiment of the present disclosure is exemplarily described above. A driving method of the above-described OLED pixel driving circuit according to an exemplary embodiment of the present disclosure will be described in detail below.

According to an exemplary embodiment of the present disclosure, the driving method of the OLED pixel driving circuit described above may include a reset compensation phase, a data writing phase, and a light emitting phase. Specifically, in the reset compensation phase, the first switch unit and the second switch unit is turned on to apply a reference voltage through the data line, and the power switch unit is turned off to stop applying the power supply voltage to the second node, so that a voltage of the fourth node is reset and the second capacitor stores a threshold voltage of the first transistor. In the data writing phase, the first switch unit is maintained to be turned on and the second switch unit is turned off, so that the first capacitor stores a data voltage from the data line. In the light emitting phase, the first switch unit is turned off, the second switch unit is maintained to turned off and the power switch unit is turned on to apply the power supply voltage to the second node, so that the first transistor drives the organic light emitting diode to emit light.

Hereinafter, referring to FIGS. 3 to 4*c*, the OLED pixel driving circuit according to an exemplary embodiment of the present disclosure will be described in detail by taking transistors (i.e., a second transistor T2, a third transistor T3, a fourth transistor T4) as the first switch unit, the second switch unit, and the power switch unit as examples. However, those skilled in the art will recognize that the first switch unit, the second switch unit, and the power switch unit are not limited to be transistors, and any structure and/or circuit capable of realizing its corresponding function can be used as the first switch unit, the second switch unit and the power switch unit.

Figure 3:
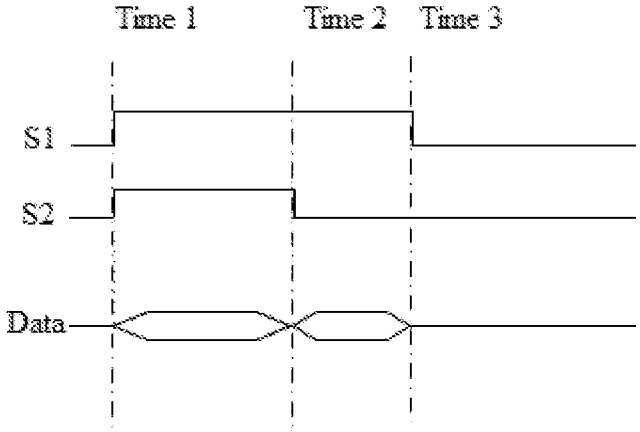
FIG. 3 is a driving timing diagram of an OLED pixel driving circuit according to an exemplary embodiment of the present disclosure.
Figure 4A:
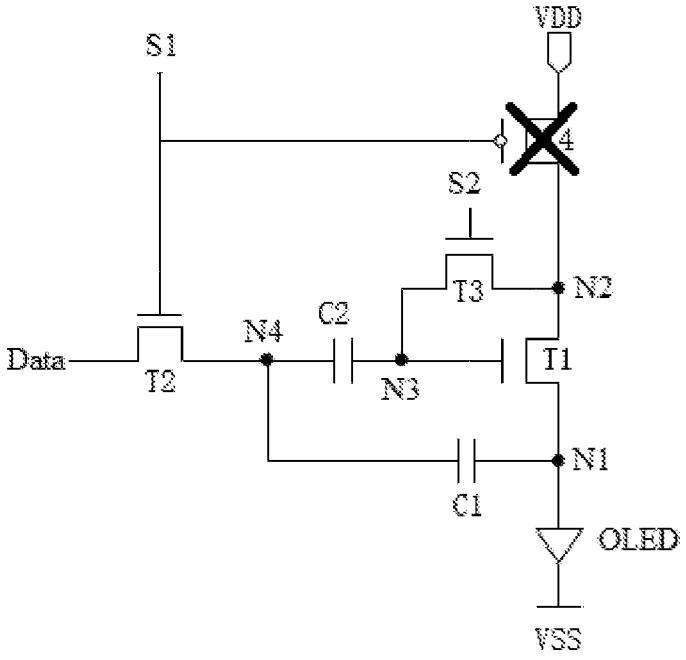
FIG. 4*a* is an equivalent circuit diagram of a first driving stage of an OLED pixel driving circuit according to an exemplary embodiment of the present disclosure.
Figure 4B:
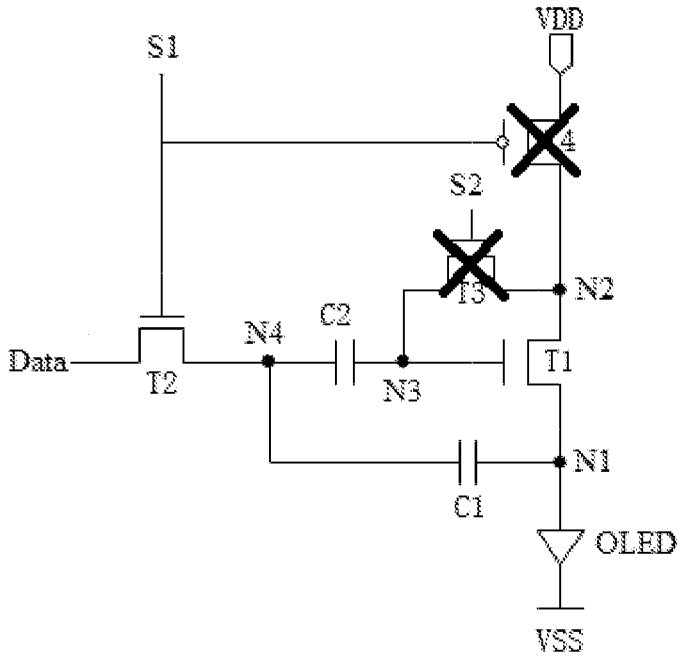
FIG. 4*b* is an equivalent circuit diagram of a second driving stage of an OLED pixel driving circuit according to an exemplary embodiment of the present disclosure.
Figure 4C:
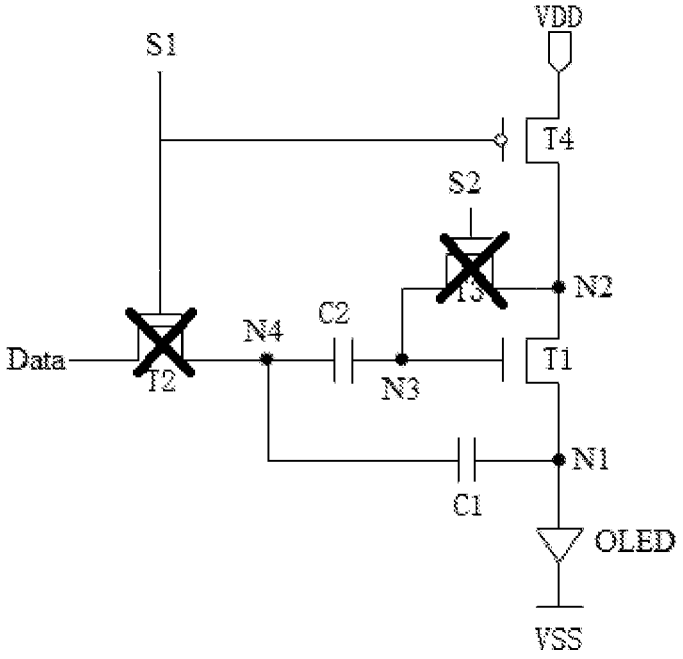
FIG. 4*c* is an equivalent circuit diagram of a third driving stage of an OLED pixel driving circuit according to an exemplary embodiment of the present disclosure.

FIG. 3 is a driving timing diagram of an OLED pixel driving circuit according to an exemplary embodiment of the present disclosure, and FIGS. 4*a* to 4*c* are equivalent circuit diagrams of respective driving stages of an OLED pixel driving circuit according to an exemplary embodiment of the present disclosure.

Referring to FIGS. 3 and 4*a*, in a first phase Time 1, that is, the reset compensation stage, the first control signal and the second control signal of high level are respectively applied via the scan line S1 and the control line S2 so that the first transistor T1, the second transistor T2 and the third transistor T3 are turned on, and the fourth transistor T4 is turned off. Thus, the reference voltage is applied via the data line Data, and the applying of the power supply voltage VDD to the second node N2 is stopped.

Therefore, the voltage of the fourth node N4 is reset. In addition, the third transistor T3 enables the first transistor T1 connected as a diode to release the voltages of the first node N1 and the third node N3, so that the voltage of the first node N1 is VSS+Voled0 and the voltage of the third node is VSS+Voled0+Vth, where VSS is a low-level voltage coupled to the organic light emitting diode OLED, Voled0 is an OLED-lighting voltage (OLED off-state threshold voltage), Vth is a threshold voltage of the first transistor T1, and Vref is a reference voltage. Therefore, the second capacitor C2 stores the threshold voltage of the first transistor T1 and the low voltage level VSS coupled to the cathode of the organic light emitting diode OLED, thereby achieving the compensation of the threshold voltage of the first transistor T1 and the low-level voltage VSS.

Referring to FIGS. 3 and 4*b*, in a second phase Time 2, that is, the data writing stage, the first control signal of high level and the second control signal of low level are respectively applied via the scan line S1 and the control line S2, so that the second transistor T2 is maintained to be turned on and the fourth transistor T4 is maintained to be turned off, and the third transistor T3 is turned off. Therefore, the first capacitor C1 stores the data voltage from the data line Data. At this time, the voltage of the fourth node N4 becomes the data voltage, and the voltage of the third node N3 becomes VSS+Voled0+Vth+Vdata−Vref due to the coupling of the second capacitor C2, where Vdata is the data voltage.

Referring to FIGS. 3 and 4*c*, in a third phase Time 3, i.e., the light emitting phase, the first control signal and the second control signal of low level are respectively applied via the scan line S1 and the control line S2 to turn off the second transistor T2, maintain the third transistor T3 turned off, and turn on the fourth transistor T4 to apply the power supply voltage VDD to the second node N2, so that the first transistor T1 drives the organic light emitting diode OLED to emit light. At this time, the voltage Vg of the third node N3 is Vg=VSS+Voled0+Vth+Vdata−Vref, and the voltage Vs of the first node N1 is Vs=VSS+Voled, where Voled is a voltage across the OLED in the OLED light emitting phase. Therefore, the light emission current $Ioled=K(Vgs-Vth)^2=K(Vdata-Vref+Voled0-Voled)^2$, where K=*Cox*W/L, and μ is the carrier mobility of the first transistor T1, Cox is the gate oxide capacitance of the first transistor T1, and W/L is the length to width ratio of the first transistor T1.

As can be seen from the above, the light emission current is independent of the low-level voltage VSS and the threshold voltage Vth of the first transistor T1, which may prevent the display brightness of the display device from being not uniform due to the difference and/or drift of the threshold voltage of the driving transistor T1 and the voltage beat of the low-level voltage of the light emitting diode OLED.

In addition, the light emission current contains the Voled0−Voled term, so the problem of display unevenness due to aging of the organic light emitting diode OLED can be compensated to a certain extent.

According to an exemplary embodiment of the present disclosure, a display device is also provided. The display device includes the above-described OLED pixel driving circuit and an organic light emitting diode. Specifically, the display device may include a plurality of pixels, and each pixel may include any of the above-described OLED pixel driving circuits and an organic light emitting diode coupled thereto. Since the OLED pixel driving circuit can compensate the threshold voltage of the driving transistor and the low level voltage coupled to the organic light emitting diode, it may prevent the display brightness of the display device from being not uniform due to the difference and/or drift of the threshold voltage of the driving transistor and the voltage beat of the low-level voltage of the light emitting diode. Therefore, the uniformity of display brightness of the display device can be improved, and thus the display quality can be greatly improved.

The specific exemplary embodiments of the present disclosure have been described in conjunction with the accompanying drawings. These exemplary embodiments are not intended to be exhaustive or to limit the present disclosure to the precise forms disclosed, and obviously, many modifications and variations will be made by those skilled in the art in light of the above teachings. Therefore, the scope of the present disclosure is not intended to be limited to the foregoing embodiments but is intended to be limited by the claims and their equivalents.

What is claimed is:

1. An OLED pixel driving circuit, comprising:

a first transistor, configured to provide a driving current to an organic light emitting diode, and comprising a first terminal, a second terminal, and a control terminal coupled to a first node, a second node, and a third node respectively, the first node being coupled to the organic light emitting diode;

a power switch unit, coupled between a power supply voltage and the second node to be turned on or off in response to a first control signal;

a first switch unit, coupled between a data line and a fourth node to couple a data voltage signal from the data line to the fourth node when being turned on in response to a signal from a scan line;

a second switch unit, coupled between the third node and the second node to enable the first transistor connected as a diode when being turned on in response to a second control signal;

a first capacitor, comprising plates respectively connected to the fourth node and the first node; and a second capacitor, coupled between the fourth node and the second node, wherein the OLED pixel driving circuit is configured to drive the organic light emitting diode to emit light by:

in a reset compensation phase, turning on the first switch unit and the second switch unit to apply a reference voltage through the data line, and turning off the power switch unit to stop applying the power supply voltage to the second node, so that a voltage of the fourth node is reset and the second capacitor stores a threshold voltage of the first transistor;

in a data writing phase, maintaining the first switch unit to be turned on and the power switch unit to be turned off, and turning off the second switch unit, so that the first capacitor stores a data voltage from the data line; and in a light emitting phase, turning off the first switch unit, maintaining the second switch unit to be turned off, and turning on the power switch unit to apply the power supply voltage to the second node, so that the first transistor drives the organic light emitting diode to emit light.

2. The OLED pixel driving circuit according to claim 1, wherein the first switch unit comprises a second transistor, and the second transistor comprises a first terminal, a second terminal, and a control terminal coupled to the data line, the fourth node, and the scan line respectively.

3. The OLED pixel driving circuit according to claim 1, wherein the second switch unit comprises a third transistor, and the third transistor comprises a first terminal, a second terminal, and a control terminal coupled to the third node, the second node, and the second control signal respectively.

4. The OLED pixel driving circuit according to claim 2, wherein the power switch unit comprises a fourth transistor, and the fourth transistor comprises a first terminal, a second terminal, and a control terminal coupled to the second node, the power supply voltage, and the first control signal respectively.

5. The OLED pixel driving circuit according to claim 4, wherein the fourth transistor is a PMOS transistor, and the second transistor is an NMOS transistor.

6. The OLED pixel driving circuit according to claim 5, wherein the first transistor is an NMOS transistor.

7. A driving method of the OLED pixel driving circuit according to claim 1, comprising:

in a reset compensation phase, turning on the first switch unit and the second switch unit to apply a reference voltage through the data line, and turning off the power switch unit to stop applying the power supply voltage to the second node, so that a voltage of the fourth node is reset and the second capacitor stores a threshold voltage of the first transistor;

in a data writing phase, maintaining the first switch unit to be turned on and the power switch unit to be turned off, and turning off the second switch unit, so that the first capacitor stores a data voltage from the data line; and in a light emitting phase, turning off the first switch unit, maintaining the second switch unit to be turned off and turning on the power switch unit to apply the power supply voltage to the second node, so that the first transistor drives the organic light emitting diode to emit light.

8. An OLED display device, comprising an OLED pixel driving circuit and an organic light emitting diode, wherein the OLED pixel driving circuit comprises:

a first transistor, configured to provide a driving current to the organic light emitting diode, and comprising a first terminal, a second terminal, and a control terminal coupled to a first node, a second node and, a third node respectively, the first node being coupled to the organic light emitting diode;

a power switch unit, coupled between a power supply voltage and the second node to be turned on or off in response to a first control signal;

a first switch unit, coupled between a data line and a fourth node to couple a data voltage signal from the data line to the fourth node when being turned on in response to a signal from a scan line;

a second switch unit, coupled between the third node and the second node to enable the first transistor connected as a diode when being turned on in response to a second control signal;

a first capacitor, comprising plates respectively connected to the fourth node and the first node; and a second capacitor, coupled between the fourth node and the second node, wherein the OLED pixel driving circuit is configured to drive the organic light emitting diode to emit light by:

in a reset compensation phase, turning on the first switch unit and the second switch unit to apply a reference voltage through the data line, and turning off the power switch unit to stop applying the power supply voltage to the second node, so that a voltage of the fourth node is reset and the second capacitor stores a threshold voltage of the first transistor;

in a data writing phase, maintaining the first switch unit to be turned on and the power switch unit to be turned off, and turning off the second switch unit, so that the first capacitor stores a data voltage from the data line; and in a light emitting phase, turning off the first switch unit, maintaining the second switch unit to be turned off, and turning on the power switch unit to apply the power supply voltage to the second node, so that the first transistor drives the organic light emitting diode to emit light.

9. The OLED display device according to claim 8, wherein the first switch unit comprises a second transistor, and the second transistor comprises a first terminal, a second terminal, and a control terminal coupled to the data line, the fourth node, and the scan line respectively.

10. The OLED display device according to claim 8, wherein the second switch unit comprises a third transistor, and the third transistor comprises a first terminal, a second terminal, and a control terminal coupled to the third node, the second node, and the second control signal respectively.

11. The OLED display device according to claim 9, wherein the power switch unit comprises a fourth transistor, and the fourth transistor comprises a first terminal, a second terminal, and a control terminal coupled to the second node, the power supply voltage, and the first control signal respectively.

12. The OLED display device according to claim 11, wherein the fourth transistor is a PMOS transistor, and the second transistor is an NMOS transistor.

13. The OLED display device according to claim 12, wherein the first transistor is an NMOS transistor.

14. The OLED pixel driving circuit according to claim 5, wherein the first control signal is from the scan line.

15. The OLED pixel driving circuit according to claim 1, wherein the power switch unit and the first switch unit are turned on and off in a complementary manner.

16. The OLED display device according to claim 12, wherein the first control signal is from the scan line.

17. The OLED display device according to claim 8, wherein the power switch unit and the first switch unit are turned on and off in a complementary manner.

* * * * *